US005329780A

United States Patent [19]

Broadbent

[11] Patent Number: 5,329,780

[45] Date of Patent: Jul. 19, 1994

[54] ICE MAKING METHOD AND APPARATUS

[75] Inventor: John A. Broadbent, Aurora, Colo.

[73] Assignee: Broad Research, Aurora, Colo.

[21] Appl. No.: 38,537

[22] Filed: Mar. 29, 1993

Related U.S. Application Data

[63] Continuation-in-part of Ser. No. 840,672, Feb. 20, 1992, abandoned, which is a continuation of Ser. No. 607,827, Nov. 1, 1990, abandoned, which is a continuation of Ser. No. 410,369, Sep. 21, 1989, Pat. No. 4,990,169, which is a continuation-in-part of Ser. No. 271,228, Nov. 14, 1988, Pat. No. 4,922,723.

[51] Int. Cl.[5] ..... F25C 1/12

[52] U.S. Cl. ..... 62/72; 62/353

[58] Field of Search ..... 62/72, 75, 347, 353

[56] References Cited

U.S. PATENT DOCUMENTS 2,952,128 9/1960 Highland ..... 137/587 X 4,412,429 11/1983 Kohl ..... 62/347

4,590,774 5/1986 Povajnuk ..... 62/347

4,986,088 1/1991 Nelson ..... 62/347

4,990,169 2/1991 Broadbent ..... 62/72

*Primary Examiner*—William E. Tapolcai

*Attorney, Agent, or Firm*—Beaton & Swanson

[57] ABSTRACT

A machine or apparatus for producing ice cubes comprising flexible membranes which are flexed into and out of thermal contact with a refrigerated evaporator core upon which conductive areas define discrete freezing sites which determine the location on the flexible membrane where the ice cubes are formed. The ice cubes are removed by flexing the flexible membrane. The flexing of the flexible membranes into and out of contact with the evaporator core may be accomplished with a fluid source which applies fluid to and removes fluid from collapsible spaces between the evaporator core and the membranes.

36 Claims, 3 Drawing Sheets

ICE MAKING METHOD AND APPARATUS

This invention is a continuation-in-part of Ser. No. 07/840,672, filed Feb. 20, 1992, now abandoned, entitled "Ice Product and Apparatus and Method for Making Same" which is a continuation of application Ser. No. 07/607,827 which was filed on Nov. 1, 1990, now abandoned, which is a continuation of application Ser. No. 07/410,369 which was filed on Sep. 21, 1989, which is now issued as U.S. Pat. No. 4,990,169, and which is a continuation-in-part of application Ser. No. 07/271,228 filed on Nov. 14, 1988, now U.S. Pat. No. 4,922,723.

FIELD OF THE INVENTION

This invention relates generally to Refrigeration. More particularly, this invention concerns a method and apparatus for freezing ice cubes on a flexible membrane.

BACKGROUND OF THE INVENTION

Automatic ice cube machines are widely used in restaurants, bars, hotels, etc. Such commercial machines typically form ice cubes by freezing a flowing stream of water on the chilled evaporator portion of a refrigeration system. After the ice has been formed to the desired thickness, the evaporator is heated, thereby melting the bond between the ice and the evaporator and allowing the ice to then fall or be pushed into an ice holding bin below. Heating of the evaporator is typically accomplished using "hot gas defrost," whereby hot refrigerant gas from the compressor is caused to bypass the condenser and go directly into the evaporator. The hot gas defrost cycle ends after the ice cubes have fallen away from the evaporator.

Such a hot gas defrost cycle adversely affects the capacity and energy efficiency of the ice machine. The ice making capacity is significantly reduced because: 1) the machine spends a substantial portion of its time defrosting, during which time no useful refrigeration is provided, 2) the ice machine melts some ice during defrost, and 3) the heat added to the evaporator during hot gas defrost must be removed from the evaporator before freezing can resume—which means that the machine's refrigerating capacity is being used to remove heat added during defrost rather than to make ice. Also, because the ice making machine is consuming energy during the defrost process but is not making ice, the energy efficiency is significantly lower than that of an ice machine with no hot gas defrost cycle.

The capacity and energy efficiency of an ice making machine are also affected by the refrigeration system's condensing temperature. It is well known that raising condensing temperature in a refrigeration system leads to a reduction of the heat transfer output and efficiency of the system. Cube making ice machines often are designed to have a higher condensing temperature than would otherwise be required in order to assure that sufficiently hot refrigerant gas is available to provide a quick defrost. This leads to lower capacity and efficiency.

Another disadvantage of ice machines using hot gas defrost is their reduced service life. An ice machine which utilizes a hot gas defrost cycle constantly cycles between warm and cold. This constant thermal cycling and the corresponding refrigerant pressure variations causes the main components to wear out faster than they would otherwise.

Various machines and methods for making ice have been available heretofore. For example, U.S. Pat. Nos. 2,610,476 and 2,990,199 to C. Field, 2,613,511 to E. C. Walsh, 2,683,356 and 2,683,359 to Charles M. Green, Jr., and 2,803,950 to J. R. Bayston all describe methods for making ice on a flexible or deformable surface which do not require a hot gas defrost cycle. However, all of these methods produce randomly shaped pieces of ice as each method fractures the ice as it is broken free of the deformable freezing surface. None of these methods allow the ice to have a controlled and consistent cross-sectional shape.

U.S. Pat. No. 4,412,429 to Vance L. Kohl describes an ice making method providing a jacket around an evaporator tube having intersecting ridges which define an array of sites for growing the ice cubes, with the "bottom" of each site being in close contact with an area of evaporator tube for freezing water applied thereto. During harvesting, water is circulated through the jacket to uniformly melt and loosen the cubes so they may fall away. The jacket may be made of a flexible plastic material so that filling said jacket with water during said harvest mode causes flexing thereof to help dislodge the ice cubes or particles.

While this method does not use a hot gas defrost and does use some flexing to remove ice from the freezing surface, it harvests the ice primarily through melting. The "bottom" of each freezing site (the primary contact area between ice and evaporator) is securely fastened to the evaporator tube and is not flexible; the ice can only be freed from this area by melting. Only the periphery of each freezing site is capable of any flexing.

Commercially available flaker-type ice machines do not utilize a hot gas defrost cycle, but they cannot make hard, clear, consistently-shaped ice cubes.

An objective of this invention is to provide a machine or apparatus for making hard, substantially clear, uniformly shaped ice cubes, which does not require hot gas defrost and which thus provides greater ice producing capacity, greater energy efficiency and longer service life than conventional cube making ice machines.

SUMMARY OF THE INVENTION

The invention herein comprises an ice making method and apparatus which provides improved ice making capacity, greater energy efficiency and longer service life through a novel means of forming and harvesting uniformly shaped ice cubes. As used herein, the term "cube" shall not be limited to describing a regular solid piece of ice with six sides, but includes solid pieces of ice of any suitable shape. This invention deals primarily with the evaporator or ice forming portion of an ice making machine. The other components required in the ice-making machine (i.e., refrigeration system, water system, ice holding bin, etc.) are similar to those found in conventional ice-making machines.

In the preferred embodiment, ice is formed on thin, flexible membranes (e.g., 0.001 to 0.003 inch-thick stainless steel) which are welded to either side of a rectangular stainless steel frame. Inside the frame and located between the two flexible membranes is a refrigerated element, hereafter referred to as the "evaporator core". This evaporator core is comprised of a serpentine length of copper tubing on which is attached an array of extruded aluminum blocks. The copper tubing and aluminum block assembly is imbedded in an insulating material such that the front and back surface of each aluminum block is un-insulated and is flush with the smooth front and back surfaces of the evaporator core. The un-insulated surfaces of the aluminum blocks form discrete conductive areas on either side of the evaporator core which define areas of high thermal conductivity between the flexible membranes and the evaporator core.

The flexible membranes, the frame and the evaporator core are arranged such that a sealed chamber is defined between each of the membranes and the evaporator core. These chambers are connected to a sealed fluid circulating circuit containing a low toxicity, low freezing temperature fluid (such as propylene glycol or DOWFROST, hereafter referred to simply as flexing fluid) which is used to flex the flexible membranes in and out of contact with the refrigerated evaporator core.

By applying a slight vacuum or lower than ambient pressure to the chambers between the flexible membranes and the evaporator core (a method for applying the vacuum will be described) the flexible membranes are drawn into intimate contact with the evaporator core. Water flowing on the exterior side of the flexible membranes freezes at those areas where there is high thermal conductivity between the flexible membranes and the refrigerated evaporator core, i.e., at the conductive areas formed by the aluminum blocks. The shape of these conductive areas thus determine the cross-sectional shape of the resulting ice cubes.

When the ice cubes have reached the desired thickness, as determined by the ice machine's control circuitry, a pump is energized which forces warm flexing fluid to flow through the chambers between the evaporator core and the flexible membranes. This causes the flexible membranes to be flexed away from the evaporator core and thereby mechanically fractures the bond between the ice and the flexible membranes and allows the ice to fall from the flexible membranes into an ice holding bin below. Keeping the flexing fluid above the freezing temperature of water (i.e., above 32 degrees F. or 0 degrees C.), also facilitates the removal of ice cubes by melting free any ice cubes which were not freed mechanically.

Once the ice has broken or melted free of the flexible membrane, again as determined by the ice machine's control circuitry, the flexing fluid pump is turned off. By locating the reservoir which holds the flexing fluid below the level of the evaporator, the flexing fluid is pulled by gravity out of the evaporator and down into the reservoir. Even after virtually all of the flexing fluid has drained out of the chambers between the flexible membranes and the evaporator core, gravity continues to apply a pulling force, or hydrostatic pressure, on the chambers. This causes a slight vacuum to exist inside the chambers between the flexible membranes and the evaporator core. This vacuum draws the flexible membranes into intimate thermal contact with the evaporator core, thereby restarting the freezing process.

During the freezing part of the ice-making cycle the flexing fluid resides in the reservoir and is heated by a heat exchanger which extracts heat from the high temperature portion of the refrigeration circuit. This keeps the flexing fluid sufficiently warm to for harvesting. The reservoir and the rest of the flexing fluid circuit is sealed to prevent evaporation and contamination of the flexing fluid. A flexible bladder connected to the reservoir serves to accommodate the volume change inside the reservoir when the flexing fluid is pumped out of the reservoir and into the evaporator.

DETAILED DESCRIPTION OF A PREFERRED EMBODIMENT

Figure 1:
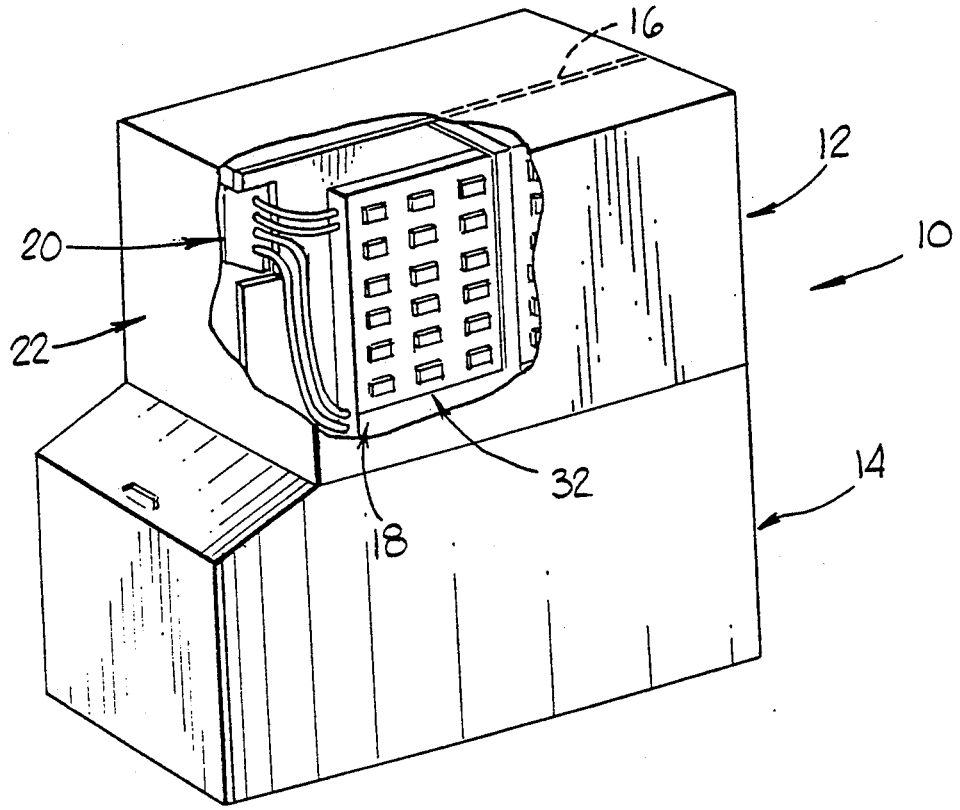
FIG. 1 is a perspective view, partly broken away, of an ice making machine embodying the present invention.

A commercial type ice making machine 10 in accordance with the present invention is shown in FIG. 1. The ice making machine 10 has an insulated cabinet 12 and is shown on top of an ice-receiving and storing bin 14. Inside the insulated cabinet 12 of the ice making machine is an insulated dividing wall 16 that separates the ice making or evaporator section 18 from the refrigeration compartment 20. Shown inside the evaporator section 18 of the machine is an ice making evaporator 32 of the present invention. Inside the refrigeration compartment 20 are housed the components in the ice making system 30 that do not come into contact with the ice making water (e.g., the compressor, condenser, etc.).

Figure 2:
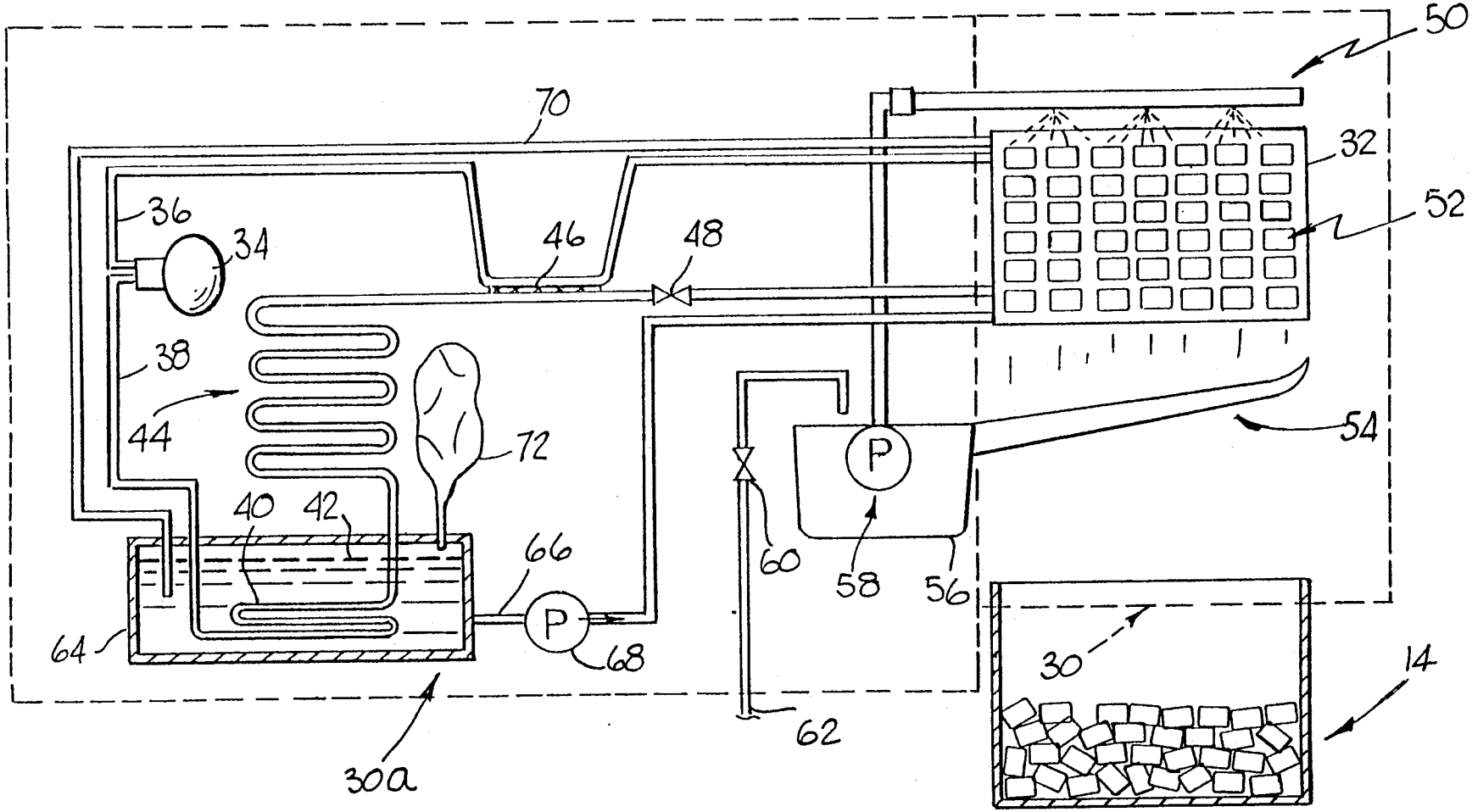
FIG. 2 is a schematic diagram illustrating the refrigeration circuit, water supply circuit, and the flexing fluid circuit of the present invention.

FIG. 2 shows a schematic diagram of the ice making system 30 incorporating the present invention. The ice making system 30 is divided into two segments, 30A and 30B. Segment 30A includes that portion of the ice making system 30 that is housed in the refrigeration compartment 20. Segment 30B is that portion of the ice making system 30 that is housed in the evaporator section 18 of the ice making machine, and includes the evaporator 32.

The refrigeration components of the ice making system 30 that are shown in segment 30A include a compressor 34 having a suction line 36 and a discharge line 38. In the discharge line 38 there is a flexing fluid heat exchanger 40 for heating the flexing fluid 42 and preventing the temperature of the flexing fluid 42 from getting too low. Also in the discharge line 38 is a condenser 44 for condensing the compressed refrigerant vapor coming from the compressor 34, a heat exchanger 46 for sub-cooling the liquid refrigerant and an expansion valve 48 for lowering the temperature and pressure of the refrigerant.

The remaining refrigeration component in the ice making system 30 is the ice making evaporator 32, which is connected between the discharge line 38 and the suction line 36. The details of evaporator 32 comprise significant features of the invention, as will be described hereinbelow. In operation, gaseous refrigerant is compressed, condensed to a liquid and then expanded and directed into the evaporator 32. Heat transferred into the liquid refrigerant causes the refrigerant to evaporate. The evaporated refrigerant passes through suction line 36 back to the compressor 34.

FIG. 2 also illustrates the water supply circuit that provides water to the evaporator 32 for making ice. A water supply manifold 50 distributes a continuous stream of water across the surface of the evaporator 32. A portion of the water which crosses the evaporator surface freezes at the freezing sites 52. The water that is not frozen while crossing the evaporator surface is collected in a water collection trough 54. The water then flows back into a water tank 56. A water pump 58 circulates water from the water tank 56 to the water supply manifold 50. Water is added to the system by means of a water valve 60 which is connected to the water supply 62.

Also shown in FIG. 2 is the flexing fluid circuit which is a part of the ice making system 30 and serves to harvest the ice from the evaporator 32. The flexing fluid circuit includes a sealed flexing fluid reservoir 64, a supply conduit 66, a flexing fluid pump 68, a return conduit 70 and a flexible bladder 72. During the harvest part of an ice-making cycle, the flexing fluid 42, which is kept warm by the flexing fluid heat exchanger 40, is circulated by the flexing fluid pump 68 through the evaporator 32. This causes the ice cubes to be harvested from the evaporator surface (as will be explained later) and drop into the ice storage bin 14.

When the harvest is completed (all the ice has been removed from the evaporator 32), the flexing fluid pump 68 is turned off. Turning off the pump 68 causes any flexing fluid 42 remaining inside the evaporator 32 to drain out of the evaporator 32 and back into the reservoir 64. To insure that this happens, it is preferable that the reservoir 64 be located such that the level of the flexing fluid 42 in the reservoir 64 is physically below the bottom of the evaporator 32. It is also preferable that the end of the return conduit 70 be located below the level of the flexing fluid 42 in the reservoir 64. If the end of return conduit 70 is not submerged, air will be drawn out of the reservoir 64 and into the evaporator 32. It is also necessary that the fluid in the reservoir 64 be maintained at atmospheric pressure.

During the harvesting process, most of the flexing fluid 42 leaves the reservoir 64 and moves into the evaporator 32. The flexible bladder 72, which is normally filled with air, accommodates this change in volume of fluid in the reservoir 64 by collapsing during the harvesting operation. The collapsing of the bladder 72 allows the air in the bladder to move into the reservoir 64 to replace the flexing fluid 42 that has left the reservoir 64. When the harvest is complete, the flexing fluid drains back into the reservoir pushing the air in the reservoir back into the bladder 72, reinflating it. Thus the bladder 72 serves to seal the flexing fluid system from the atmosphere (preventing unwanted evaporation and contamination of the flexing fluid) while keeping the flexing fluid 42 at atmospheric pressure and allowing it to move freely into and out of the reservoir 64.

Figure 3:
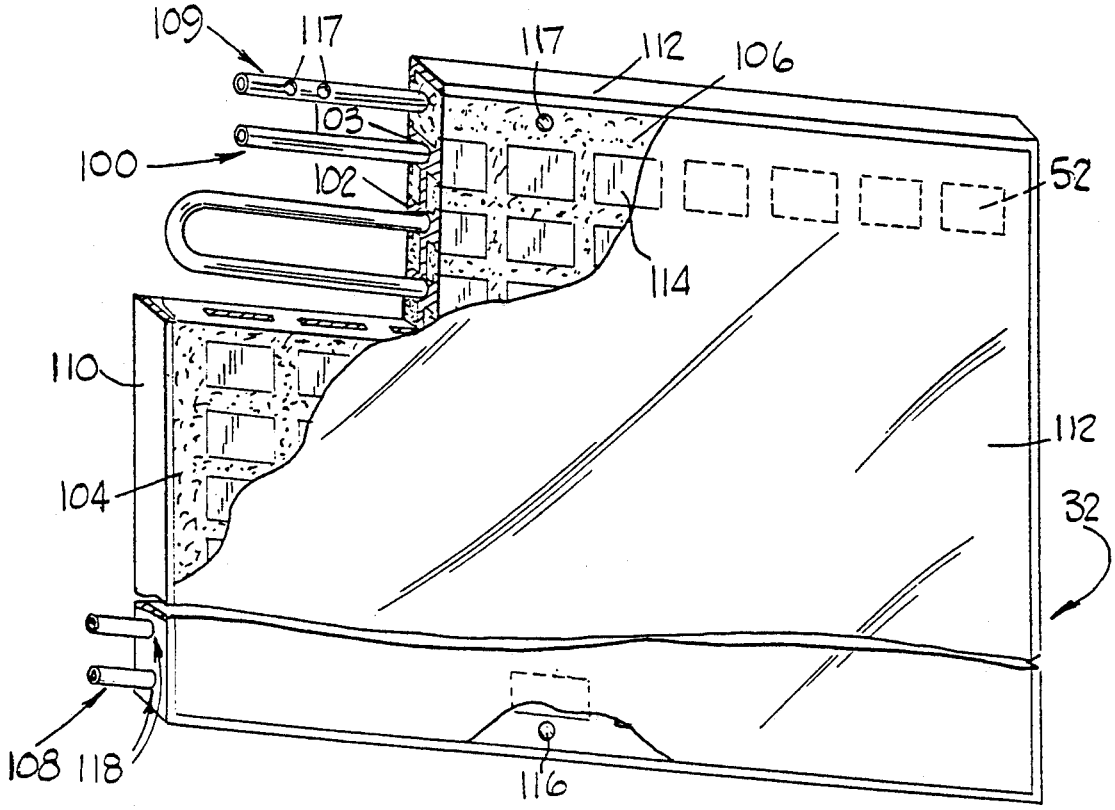
FIG. 3 is a perspective view, partly broken away, of the preferred embodiment of the evaporator.

FIG. 3 is a perspective, partially broken away view of the evaporator 32. Starting from the inside, the evaporator 32 consists of a serpentine length of copper tubing 100 through which the refrigerant passes. The tubing 100 is connected to an array of extruded aluminum blocks 102. The tubing 100 and the aluminum blocks 102 are embedded in an insulating material 104, urethane foam for example, which forms the evaporator core 106. The front and back surfaces of the evaporator core 106 are smooth and planar. (The back surface of the evaporator 32 and the back surface of the evaporator core 106 are not shown in FIG. 3.)

Also embedded in the evaporator core are the flexing fluid entrance tube 108 and the flexing fluid exit tube 109. These tubes provide conduits for the flexing fluid to enter and exit the evaporator 32.

The evaporator core 106 is mounted inside a stainless steel frame 110. Welded directly to the front and back of the stainless steel frame 110 are two flexible membranes 112 upon which the ice cubes will be formed. The flexible membranes 112 are, in the preferred embodiment, thin sheets (0.001 to 0.003 inches thick) of stainless steel.

Also illustrated in FIG. 3 are the exposed conductive areas 114 which control where and in what shape the ice cubes form. The exposed conductive areas 114 are portions of the extruded aluminum blocks 102 that are not covered with the insulating material 104, but which are flush with the rest of the surface of the evaporator core 106.

During the freezing part of an ice-making cycle, the flexible membranes 112 are brought into intimate thermal contact with these conductive areas 114, thereby creating discrete refrigerated spots or freezing sites 52 on the exterior side of the flexible membranes 112 where the ice cubes are formed.

FIG. 3 also shows the flexing fluid entrance holes 116 and the flexing fluid exit holes 117. The flexing fluid entrance holes 116 pass through the surface of the evaporator core 106 and into the flexing fluid entrance tube 108. Similarly, the exit holes 117 pass through the surface of the evaporator core 106 and into the exit tube 109.

The entrance holes 116 allow the flexing fluid 42 to flow from the entrance tube 108 into the space between the surface of the evaporator core 106 and the flexible membranes 112. This flow of flexing fluid 42 occurs during the harvest part of the ice-making cycle to remove the ice cubes from the flexible membranes 112. The flexing fluid 42 circulates through the evaporator and then leaves by flowing through the exit holes 117 and into the exit tube 109.

The bond between the copper tubing 100 and the aluminum blocks 102 is accomplished as follows: The aluminum blocks are fabricated such that they have holes 103 running through them that are slightly larger than the nominal outside diameter of the copper tubing 100. The copper tubing 100 is threaded through these holes 103 and then expanded such that the final outside diameter of the copper tubing 100 is slightly larger than the inside diameter of the holes 103. The expansion of the copper tubing 100, which can be accomplished either through applying hydraulic pressure to the inside of the tubing or by driving a mandrel through the inside of the tubing, provides a very tight mechanical bond between the tubing 100 and the aluminum blocks 102. A good thermal conduction path between the aluminum blocks 102 and the tubing 100, which is needed to make ice effectively, is created by this mechanical bond.

The joints 118 where the copper tubing 100, the flexing fluid entrance tube 108, and the flexing fluid exit tube 109 pass through the frame 110 are sealed by expanding the tubes into the frame 110 with a rotary tubing expander. This creates a seal which will not affect the weld between the frame 110 and the membranes 112.

Figure 4A:
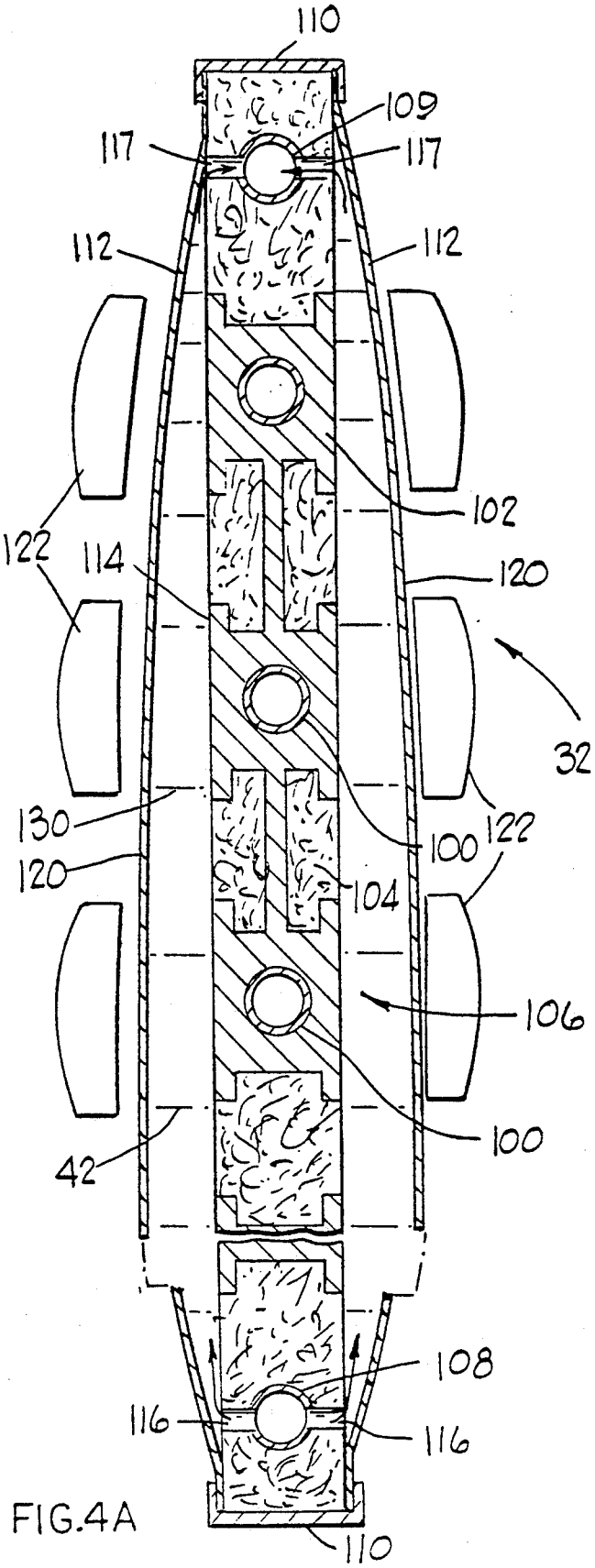
FIG. 4A is a cross-sectional view, taken along the line 4—4 of FIG. 2, illustrating the evaporator during the ice-harvesting portion of the operating cycle.
Figure 4:
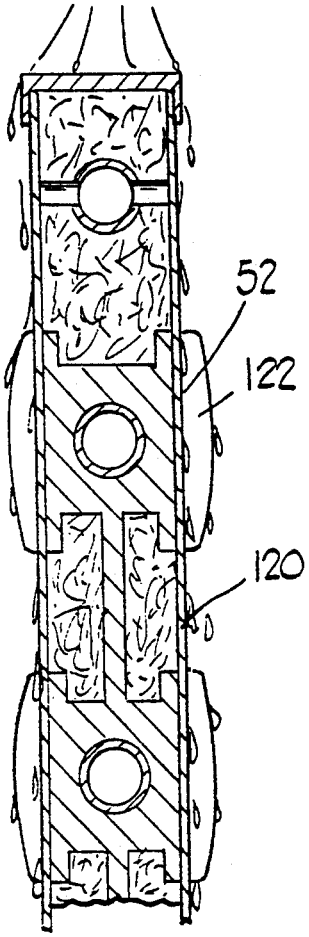
FIG. 4 is a cross-sectional view of the evaporator, taken along the line 4—4 of FIG. 2, illustrating the evaporator during the ice-forming portion of the operating cycle.

FIGS. 4 and 4A are cross-sectional views of the evaporator 32 which illustrate the sequence of operation of the present invention. FIG. 4 illustrates the evaporator 32 during the freezing part of an ice-making cycle. During this part of the cycle, the flexible membranes 112 are pulled tightly against the evaporator core 106 by negative pressure (with respect to gage pressure) in the flexing fluid. This creates intimate thermal contact and a highly conductive thermal path between the refrigerated conductive areas 114 and the flexible membranes 112. Those areas of the flexible membranes 112 that are in contact with the insulation 104 have a very low conductivity thermal path to any refrigerated components. Thus the construction of the evaporator core 106 creates areas of high and areas of low thermal conductivity between the refrigerated copper tubing 100 and the flexible membranes 112. Those areas of the flexible membranes 112 which are in contact with the exposed conductive areas 114, and which therefore have a high conductivity thermal path to the refrigerated copper tubing 100, are the areas upon which ice will form, i.e., the freezing sites 52. Areas of the flexible membranes 112 which are in contact with the insulation 104 will not form ice.

As water 120 flows over the exterior sides of the flexible membranes 112, ice cubes 122 will form on the freezing sites 52. Ice will not form on those areas of the flexible membranes 112 that are in contact with the insulated portions of the evaporator core 106.

Once the ice cubes 122 have reached their desired thickness, the freezing portion of the ice-making cycle is terminated and the harvest portion of the ice-making cycle is initiated. FIG. 4A illustrates the evaporator 32 in the harvest portion of an ice-making cycle.

Harvest is initiated by energizing the flexing fluid pump 68 (shown in FIG. 2). The flexing fluid pump 68 pumps warm flexing fluid 42 through the flexing fluid entrance tube 108, through the flexing fluid entrance holes 116 and into the chambers 130 between the flexible membranes 112 and the evaporator core 106. This causes the flexible membranes 112 to be flexed away from the evaporator core 106 by the positive pressure (with respect to gage) of the flexing fluid. This flexing action mechanically fractures the bond between the ice cubes 122 and the flexible membranes 112. Because the flexing fluid 42 is warm (it is heated during the freezing portion of the cycle by the flexing fluid heat exchanger 40, shown in FIG. 2), it also warms the flexible membranes 112 during harvest and thereby melts free any ice cubes 122 that were not freed by the flexing action. Throughout the harvest, the flexing fluid 42 is circulated through the chambers 130 and out the flexing fluid exit tube 109. Circulating the flexing fluid 42 in this manner insures that sufficient heat is provided to the flexible membranes 112 to free all of the ice cubes 122.

Once all of the ice cubes 122 have been removed from the flexible membranes 112, as determined by control circuitry in the ice making machine, the harvest is terminated. This is done by simply turning off the flexing fluid pump 68. Once the pump 68 has been turned off, the flexing fluid 42 that is inside the chambers 130 is pulled, by gravity, out of the chambers 130 and down into the flexing fluid reservoir 64. This occurs because the reservoir 64 is located below the level of the chambers 130. As the flexing fluid 42 drains out of the chambers 130, the flexible membranes 112 are pulled back into contact with the evaporator core 106. Even after virtually all of the flexing fluid 42 has drained out of the chambers 130, the weight of the fluid in the flexing fluid supply conduit 66 and the return conduit 70 creates hydrostatic pressure which in turn produces a slight vacuum inside the chambers 130. This vacuum causes the flexible membranes 112 to be pulled tightly against the evaporator core 106, again creating intimate thermal contact between the flexible membranes 112 and the exposed conductive areas 114, thereby restarting the freezing process.

As the ice-making cycle repeats, only the flexing fluid pump 68 is turned on and off. The compressor 34 and the water circulating pump 58 remain energized until the ice holding bin has been filled, at which time the entire ice machine is turned off.

As used herein, "positive" pressure in the flexing fluid means a pressure greater than the pressure on the ice-forming side of the membrane (which is typically but not necessarily at atmospheric pressure), and "negative" pressure means pressure less than the pressure on the ice-forming side of the membrane. Thus, a negative flexing fluid pressure draws the membrane toward the evaporator while a positive flexing fluid pushes the membrane away from the evaporator. It should also be noted that the description above refers to an evaporator core; this evaporator core need not actually constitute the evaporator of a refrigeration system, but may instead be some other refrigerated element such as a member in thermal communication with an evaporator.

What is claimed is:

1. An apparatus for making ice from water comprising: a refrigerated element having at least two sides; at least one flexible ice forming membrane on each said side of the refrigerated element; and means for flexing said membranes into and out of contact with said sides of the refrigerated element whereby said ice forms on said membranes when said membranes are flexed into contact with said refrigerated element, and said ice is detached from said membranes when said membranes are flexed out of contact with said refrigerated element.

2. The apparatus of claim 1, wherein: the means for flexing the membrane includes a fluid source and means for transferring said fluid from the fluid source to between the refrigerated element and the membrane, whereby the transfer of fluid to between the refrigerated element and the membrane produces a positive pressure between the refrigerated element and the membrane to flex the membrane away from the refrigerated element.

3. The apparatus of claim 2, wherein: the means for flexing the membrane further includes means for transferring said fluid away from between the refrigerated element and the membrane, whereby the transfer of fluid away from between the refrigerated element and the membrane produces a negative pressure between the refrigerated element and the membrane to flex the membrane into contact with the refrigerated element.

4. The apparatus of claim 3, wherein: said fluid source is a fluid reservoir located lower than the refrigerated element, said means for transferring fluid to between the refrigerated element and the membrane includes a pump in fluid communication with the fluid reservoir, and said means for transferring fluid away from between the refrigerated element and the membrane is a conduit whereby the fluid drains from between the refrigerated element and the membrane to the reservoir.

5. The apparatus of claim 4, wherein: the fluid is isolated from the atmosphere.

6. The apparatus of claim 5, wherein: the fluid reservoir is expandable to accommodate the fluid flowing away from between the refrigerated element and the membrane to the fluid reservoir.

7. The apparatus of claim 6, wherein: the reservoir includes an expandable bladder.

8. The apparatus of claim 1, further comprising: means for producing at least one area of high thermal conductivity between each of the two refrigerated element sides and the ice forming membrane on said side, and at least one area of low thermal conductivity between each of the two refrigerated element sides and the ice forming membrane on said side, whereby ice forms on said membranes over said area of high thermal conductivity and ice does not form on said membranes over said areas of low thermal conductivity.

9. The apparatus of claim 8, wherein: the area of high thermal conductivity is a metallic element, the metallic element having one side flush with one side of said refrigerated element and the metallic element having another side flush with the other side of said refrigerated element.

10. The apparatus of claim 9, wherein: the refrigerated element includes a plurality of metallic elements having one side flush with one side of the refrigerated element and another side flush with the other side of the refrigerated element, the plurality of metallic elements being separated from each other by insulation and each metallic element constituting an area of high thermal conductivity.

11. The apparatus of claim 1, wherein: said refrigerated element comprises a serpentine tubing carrying refrigerant; a set of blocks attached to the tubing, each block having one side flush with one side of the refrigerated element and another side flush with the other side of the refrigerated element; and insulation separating the blocks.

12. The apparatus of claim 11, wherein: the blocks include holes for receiving the tubing, and the tubing is expanded against the holes to produce an interference fit between the blocks and the tubing.

13. The apparatus of claim 12, wherein: the refrigerated element is substantially planar.

14. An apparatus for simultaneously making a plurality of pieces of ice from water, comprising: a refrigerated element having a side, the refrigerated element having a plurality of areas of high thermal conductivity separated from one another by insulation; a flexible ice forming membrane on said refrigerated element side; and means for flexing said membrane into and out of contact with said refrigerated element whereby ice forms on said membrane when said membrane is flexed into contact with said refrigerated element, and said ice is detached from said membrane when said membrane is flexed out of contact with said refrigerated element.

15. The apparatus of claim 14, wherein: the means for flexing the membrane includes a fluid source and means for transferring said fluid from the fluid source to between the refrigerated element and the membrane, whereby the transfer of fluid to between the refrigerated element and the membrane produces a positive pressure between the refrigerated element and the membrane to flex the membrane away from the refrigerated element.

16. The apparatus of claim 15, wherein: the means for flexing the membrane further includes means for transferring said fluid away from between the refrigerated element and the membrane, whereby the transfer of fluid away from between the refrigerated element and the membrane produces a negative pressure between the refrigerated element and the membrane to flex the membrane into contact with the refrigerated element.

17. The apparatus of claim 16, wherein: said fluid source is a fluid reservoir located lower than the refrigerated element, said means for transferring fluid to between the refrigerated element and the membrane includes a pump in fluid communication with the fluid reservoir, and said means for transferring fluid away from between the refrigerated element and the membrane is a conduit whereby the fluid drains from between the refrigerated element and the membrane to the reservoir.

18. The apparatus of claim 17, wherein: the fluid is isolated from the atmosphere.

19. The apparatus of claim 18, wherein: the fluid reservoir is expandable to accommodate the fluid flowing away from between the refrigerated element and the membrane to the fluid reservoir.

20. The apparatus of claim 19, wherein: the reservoir includes an expandable bladder.

21. An apparatus for making ice comprising: refrigerated evaporator core; a frame surrounding said evaporator core; a first flexible sheet attached to said frame such that said evaporator core is sealed inside said frame and said sheet; a water circulating means for flowing water over said flexible sheet; and means for flexing said flexible sheet into and out of contact with said evaporator core whereby said ice forms on said flexible sheet when said flexible sheet is flexed into contact with said evaporator core, and said ice is detached from said flexible sheet when said flexible sheet is flexed out of contact with said evaporator core.

22. The apparatus of claim 21, further comprising: a second flexible sheet attached to said frame opposite the first flexible sheet such that the evaporator core is sealed inside the frame and the first and second flexible sheets, and wherein the water circulating means includes means for circulating water over bottom the first flexible sheet and second flexible sheet; and wherein the flexing means includes means for flexing both sheets into and out of contact with the evaporator core.

23. The apparatus of claim 21, wherein: the means for flexing the sheet includes a fluid source and means for transferring said fluid from the fluid source to between the evaporator core and the sheet, whereby the transfer of fluid to between the evaporator core and the sheet produces a positive pressure between the evaporator core and the sheet to flex the sheet away from the evaporator core.

24. The apparatus of claim 23, wherein: the means for flexing the sheet further includes means for transferring said fluid away from between the evaporator core and the sheet, whereby the transfer of fluid away from between the evaporator core and the sheet produces a negative pressure between the evaporator core and the sheet to flex the sheet into contact with the evaporator core.

25. The apparatus of claim 24, wherein: said fluid source is a fluid reservoir located lower than the evaporator core, said means for transferring fluid to between the evaporator core and the sheet includes a pump in fluid communication with the fluid reservoir, and said means for transferring fluid away from between the evaporator core and the sheet is a conduit whereby the fluid drains from between the evaporator core and the sheet to the reservoir.

26. The apparatus of claim 25, wherein: the fluid is isolated from the atmosphere.

27. The apparatus of claim 26, wherein: the fluid reservoir is expandable to accommodate the fluid flowing away from between the evaporator core and the sheet to the fluid reservoir.

28. The apparatus of claim 27, wherein: the reservoir includes an expandable bladder.

29. A cyclical method for making ice from water, comprising: flexing a first flexible sheet into contact with a first side of an evaporator core and flexing a second flexible sheet into contact with a second side of the evaporator core; flowing water over the flexible sheets to solidify the water into ice on the sheets; flexing the flexible sheet out of contact with the evaporator core to detach the ice from the sheet; and repeating said series of steps.

30. The method of claim 29, wherein: the step of flexing the flexible sheets into contact with the evaporator core is by drawing a fluid out of between the flexible sheets and evaporator core to produce a negative pressure between the flexible sheets and evaporator core.

31. The method of claim 30, wherein: the step of flexing the flexible sheets out of contact with the evaporator core includes introducing a fluid to between the evaporator core and the flexible sheets to produce a positive pressure between the evaporator core and flexible sheet.

32. The method of claim 31, wherein: the fluid is stored in a fluid reservoir, and the step of drawing fluid out of between the evaporator core and the flexible sheets includes transferring said fluid to the fluid reservoir, and the step of introducing fluid to between the evaporator core and the flexible sheets include transferring said fluid from the fluid reservoir.

33. The method of claim 32, wherein: said fluid reservoir is sealed from the atmosphere to prevent fluid from escaping to the atmosphere and to prevent contamination of the fluid.

34. The method of claim 33, wherein: the reservoir is expandable to accommodate fluid flowing into the reservoir.

35. The method of claim 34, wherein: the reservoir is a flexible bladder.

36. The method of claim 29, wherein: the evaporator has a plurality of areas of high thermal conductivity separated by a plurality of areas of low thermal conductivity, and said step of flowing water over the flexible sheets to solidify the water into ice produces a separate piece of ice at each area of the flexible sheets covering an area of high thermal conductivity and does not produce ice at each area of low thermal conductivity.

* * * * *